United States Patent [19]

Stakes

[11] Patent Number: 4,458,783

[45] Date of Patent: Jul. 10, 1984

[54] ROOF LADDER ATTACHMENT

[76] Inventor: John W. Stakes, 903 Amador St., Jackson, Calif. 95642

[21] Appl. No.: 427,761

[22] Filed: Sep. 29, 1982

[51] Int. Cl.[3] ..... E06C 7/48; E06C 1/36

[52] U.S. Cl. ..... 182/206; 182/45; 182/107; 182/214; 248/237; 248/210

[58] Field of Search ..... 182/45, 107, 108, 214, 182/206; 248/210, 211, 237, 238

[56] References Cited

U.S. PATENT DOCUMENTS

| | | | |
|---|---|---|---|
| 599,963 | 3/1898 | Hatch | 182/206 |
| 681,649 | 8/1901 | Chase | 182/45 |
| 2,341,510 | 2/1944 | Born | 182/206 |
| 2,934,163 | 4/1960 | Ladewski | 182/214 |
| 3,169,503 | 2/1965 | Lane | 182/214 |
| 3,266,593 | 8/1966 | Okie | 182/214 |
| 4,179,011 | 12/1979 | Morawski | 182/45 |
| 4,311,207 | 1/1982 | Lurry | 182/45 |

*Primary Examiner*—R. P. Machado

[57] ABSTRACT

A ladder attachment consisting of two triangular plates with holes and connecting rods. When connected through the rungs of a conventional extension ladder it forms a frame on the outsides of the ladder that can be adjustably extended over the ridge of a roof.

The attachment allows the ladder to conform to the roof's pitch and be secured to the roof's ridge.

1 Claim, 4 Drawing Figures

ROOF LADDER ATTACHMENT

BACKGROUND OF THE INVENTION

There is a need for a simplified adjustable ladder attachment for trades people including chimney sweeps, roofers, painters, firemen, antenna installers, and homeowners. This present invention is designed to fill this need.

This attachment consists of two triangular plates (with holes for adjustment to various roof pitches), lock washers, and wing nuts. When assembled and attached to the sides of an extension ladder, it forms an adjustable attachment which is placed over the ridge of a roof to secure the ladder to the roof and allow the ladder to conform to the pitch of the roof.

Although a number of devices have been used, including U.S. Pat. Nos. 4311207, 2934163, 4179011 and 2341510, the advantages of this invention are that it has fewer parts, allowing it to be very mobile, and it is easily and inexpensively manufactured. Its well balanced construction provides stability. Its design allows freedom from obstruction of the working side of the ladder, permitting full use of the entire ladder surface. It is adjustable to a roof's pitch. It is easily assembled, disassembled and its simplicity of parts allows compact storage.

DETAILED DESCRIPTION OF THE INVENTION

Figure 1:
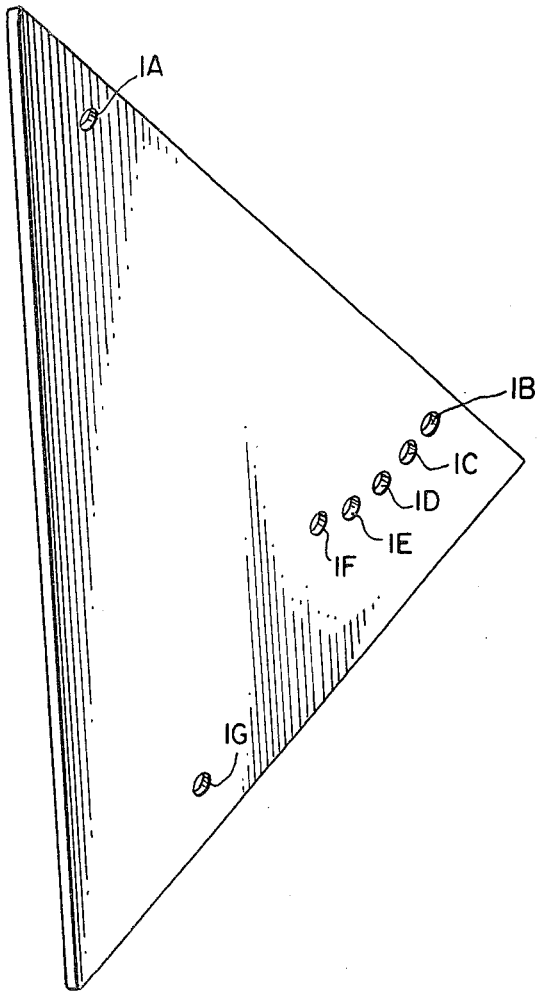
FIG. 1 is a side view of the triangular plate.
Figure 2:
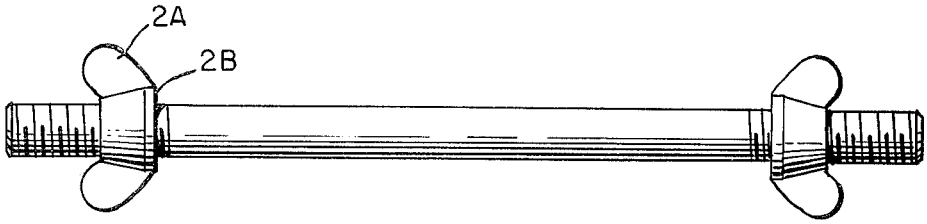
FIG. 2 a view of connecting rod with lock washers and wing nuts.

This adjustable ladder attachment consists of two triangular plates, FIG. 1; three rods threaded on each end, FIG. 2; six lock washers, 2B; six wing nuts, 2A.

Figure 3:
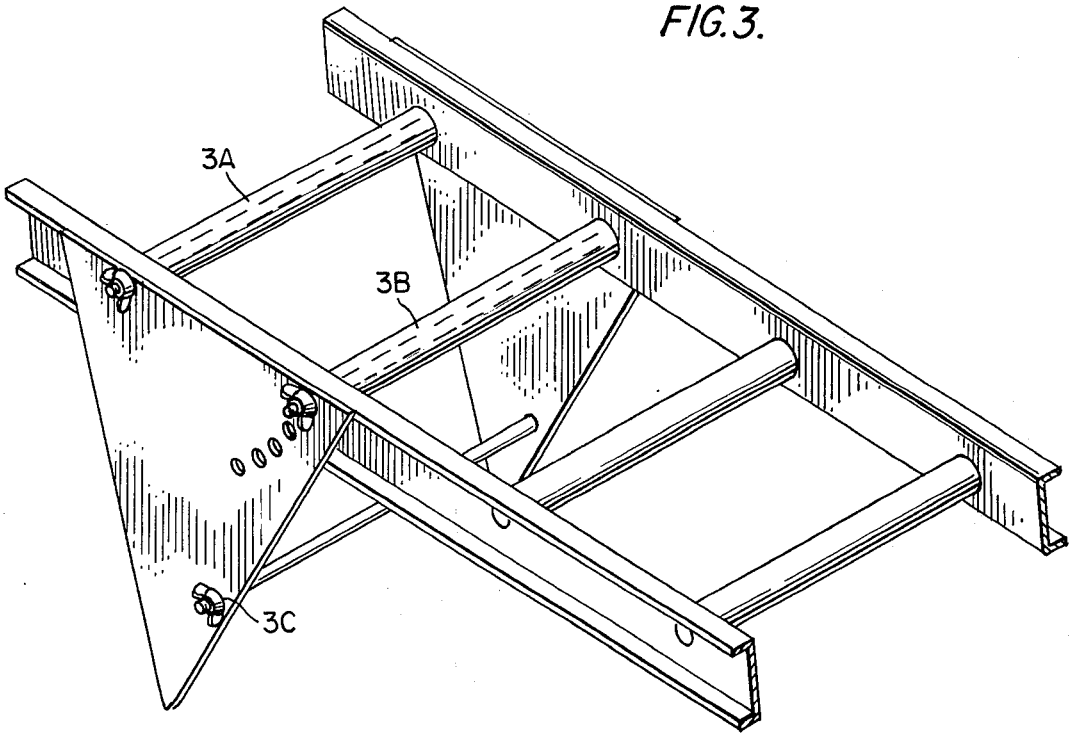
FIG. 3 a perspective view of brackets attached to ladder.
Figure 4:
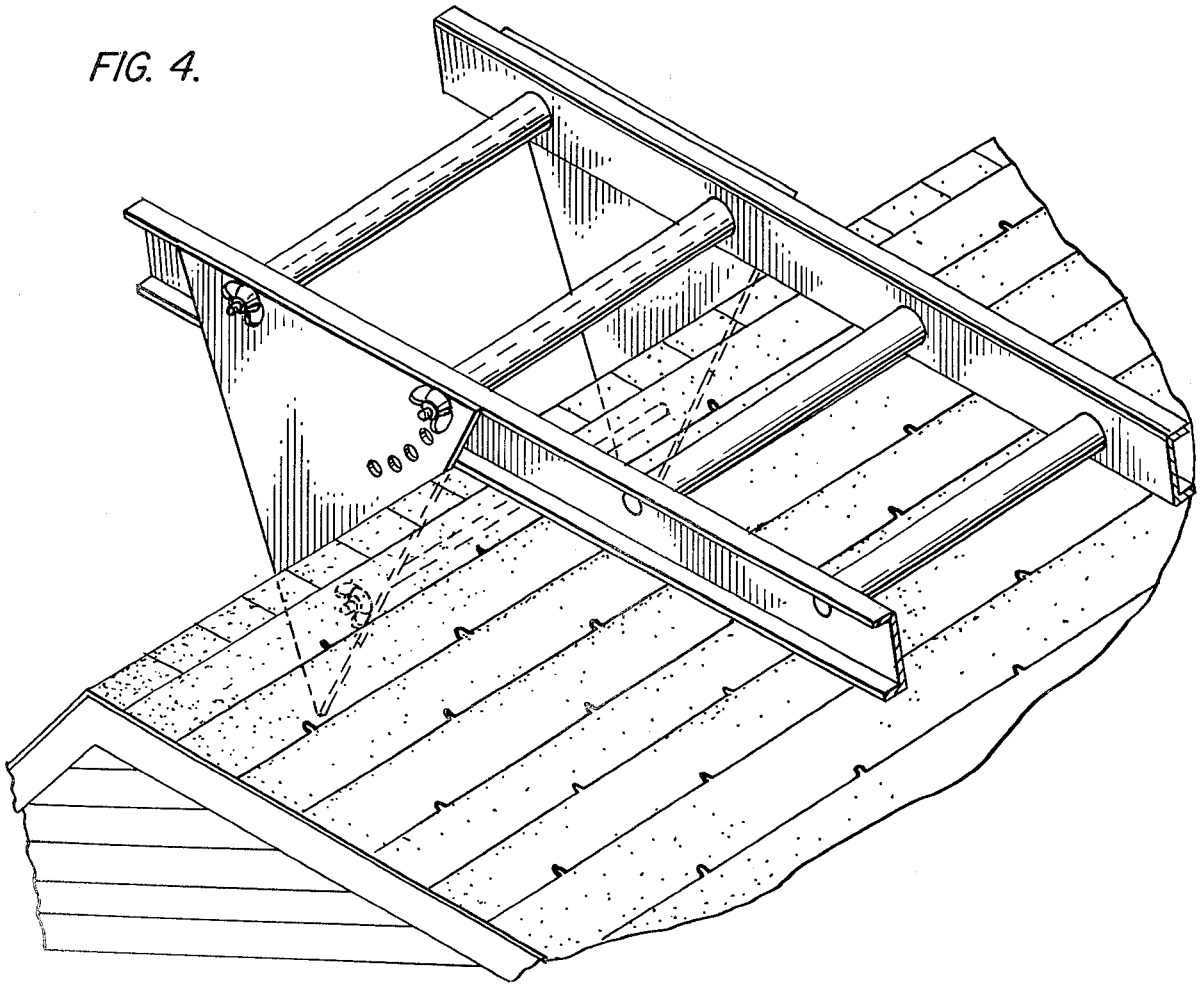
FIG. 4 an elevational view of the attachment and ladder mounted on the roof.

Each plate has seven holes. Holes 1A line up to one tubular rung of an extension ladder 3A. Holes 1G are used to brace frame 3C. Holes 1B through 1F form an arc 12 inches from holes 1A, lining up with the next lower rung of ladder 3B. Using one rod FIG. 2, insert through hole 1A of one plate through 1 tubular rung FIG. 3A, and through second plates hole 1A. Then secure plates to the rod with one lock washer 2B and wing nut 2A on each end.

Using a second rod FIG. 2, insert through hole 1G of each plate and secure with one lock washer 2B and one wing nut 2A on each end.

The third rod FIG. 2, is inserted in one of the plates 5 holes 1B, 1C, 1D, 1E, 1F (to conform to the pitch of the roof), through the tubular rung 3B, through the matching hole of the second plate, and secured at each end with one lock washer 2B and one wing nut 2A.

The assembling of this attachment forms an adjustable frame which secures the ladder to the ridge of the roof and allows the ladder to conform to the pitch of the roof.

It is possible to vary the size or shape of the triangular plates or to vary the positions or amount of holes and still be true to the basic concept of this invention and the following claim.

I claim:

1. A ladder attachment comprised of a rigid triangular frame having a pair of spaced parallel triangular side plates connected with rods attachable to the side rails of a ladder having hollow rungs wherein each said plate has: one opening position in one angle of the plates for securing first plate to said ladder and to second plate with rod attachment through said opening and through the hollow rung of said ladder; additional openings are positioned in second angle of the plates for securing and adjusting plates to said ladder by means of inserting a rod through said additional openings and additional hollow rung allowing said ladder to conform to pitch of roof and allowing the attachment to extend over the ridge of roof securing the ladder in position on roof; an additional opening is placed in the other angle of the plates for connecting a third rod for securing and stabilizing the two remaining angles of the triangular plates.

* * * * *